US006146054A

United States Patent [19]

Tessonneau

[11] Patent Number: 6,146,054

[45] Date of Patent: Nov. 14, 2000

[54] LIGHTWEIGHT EMBANKMENT

[75] Inventor: Herve Tessonneau, Dardilly, France

[73] Assignee: SCREG, Boulogne-Billancourt, France

[21] Appl. No.: 08/981,306

[22] PCT Filed: Apr. 16, 1997

[86] PCT No.: PCT/FR97/00689

§ 371 Date: Mar. 31, 1998

§ 102(e) Date: Mar. 31, 1998

[87] PCT Pub. No.: WO97/39195

PCT Pub. Date: Oct. 23, 1997

[30] Foreign Application Priority Data

Apr. 18, 1996 [FR] France ..... 96/04879

[51] Int. Cl.[7] ..... E01C 3/00; E02D 5/00; E02D 17/00; E02D 17/18

[52] U.S. Cl. ..... 405/258; 405/284; 404/29; 404/31; 238/11

[58] Field of Search ..... 405/258, 284, 405/286, 287, 287.1; 404/29, 31, 32, 34, 42; 238/2, 11

[56] References Cited

U.S. PATENT DOCUMENTS

| | | | |
|---|---|---|---|
| 118,216 | 8/1871 | Deutsch | 404/29 |
| 238,706 | 3/1881 | Murphy | 404/29 |
| 777,860 | 12/1904 | Nash | 405/29 |
| 1,402,942 | 1/1922 | Margetts | 404/29 |
| 1,636,113 | 7/1927 | Streator | 404/29 |
| 1,636,114 | 7/1927 | Streator | 404/29 |
| 3,822,955 | 7/1974 | Haferkamp et al. | 404/31 |
| 5,251,997 | 10/1993 | Brock | 404/29 |
| 5,624,211 | 4/1997 | Anderson et al. | 405/284 X |

FOREIGN PATENT DOCUMENTS

2720088 A1 11/1995 France .

*Primary Examiner*—Eileen D. Lillis
*Assistant Examiner*—Tara L. Mayo
*Attorney, Agent, or Firm*—Sughrue, Mion, ZInn, Macpeak & Seas, PLLC

[57] ABSTRACT

The lightweight embankment (1) comprises blocks (3) stacked in successive layers, the blocks of the same layer being separated by gaps (7). The blocks can in particular be made of expanded polystyrene. Application to embankments to support roads.

26 Claims, 3 Drawing Sheets

LIGHTWEIGHT EMBANKMENT

BACKGROUND OF THE INVENTION

The present invention relates to a lightweight embankment and more particularly to the technique of constructing an embankment of this kind.

Conventional road embankments are constructed from excavated materials with a density around 2,000 kg/m$^3$.

In some cases, to deal with specific problems (compressible soils, unstable slopes, etc) it is beneficial to use lighter materials.

This is why many embankments have been constructed in recent years with construction blocks made from extremely light materials having a density that is typically between about 20 kg/m$^3$ and about 60 kg/m$^3$, for example expanded polystyrene or some other ultra-lightweight cellular structure high-grade plastics material. The technique currently employed typically consists in stacking contiguously blocks of EC or EM grade polystyrene in accordance with a French standard imposing a density between 19 kg/m$^3$ and 20 kg/m$^3$.

However, these blocks made from high-grade materials produced by the chemicals industry are very costly and the current technique requires a considerable quantity of construction blocks.

SUMMARY OF THE INVENTION

This is why the object of the invention is to provide more economical lightweight embankments requiring less construction materials whilst retaining satisfactory stability properties.

To this end, the invention consists in a lightweight embankment comprising blocks stacked in successive layers characterized in that in at least one layer at least two blocks of said layer are separated from each other by a gap.

The device in accordance with the invention can have one or more of the following features:

- the blocks have a substantially parallelepipedal general shape;
- the blocks of two adjacent layers are laid transversely to each other;
- the blocks of the same layer are laid in parallel rows;
- the blocks of the same layer have the same height and the blocks of at least two different layers have different heights;
- the blocks are made from a plastics material, in particular expanded polystyrene;
- the blocks are made from a material having a density greater than 21 kg/m$^3$, in particular greater than 23 kg/m$^3$, and having a compressive strength at 10% crushing greater than 110 kPa, in particular greater than 130 kPa;
- at least one block of at least one layer is connected to at least one other block of at least one adjacent layer by connecting means;
- the connecting means are formed by an adhesive material, in particular glue;
- the connecting means are formed by at least one rod, in particular a vertical steel rod, projecting from the block and adapted to engage in a block of an adjacent layer;
- the width of the gaps of the lower layers is greater than the width of the gaps of the upper layers;
- the blocks of the cover layer of the embankment are laid contiguously;

- at least one end of at least one gap and preferably all the ends of all the gaps are closed by plugs;
- at least one embankment locating member is accommodated in at least one gap;
- the width of the gaps that house a locating member is less than the width of the other gaps of the same layer and the height of the blocks of this layer is less than the height of at least one other layer of the embankment;
- the embankment locating members are connected at one end to a slope anchor member, the anchor member being in particular common to a plurality of locating members of the same layer;
- the embankment locating member is formed by concrete poured into a gap forming stay-in-place shuttering, the ends of this gap and the openings of the latter that communicate with a gap of a lower layer being blocked by barrier members;
- the slope anchor member is formed by concrete poured into a gap between the slope and the embankment;
- at least one end of at least one gap forming stay-in-place shuttering has a widened part in which the locating member forms a retaining member for the blocks of the embankment;
- the nature and/or the density of the blocks varies from one layer to another.

Other features and advantages of the invention will emerge from the following description given by way of non-limiting example with reference to the accompanying drawings, in which:

DESCRIPTION OF PREFERRED EMBODIMENTS

Figure 1:
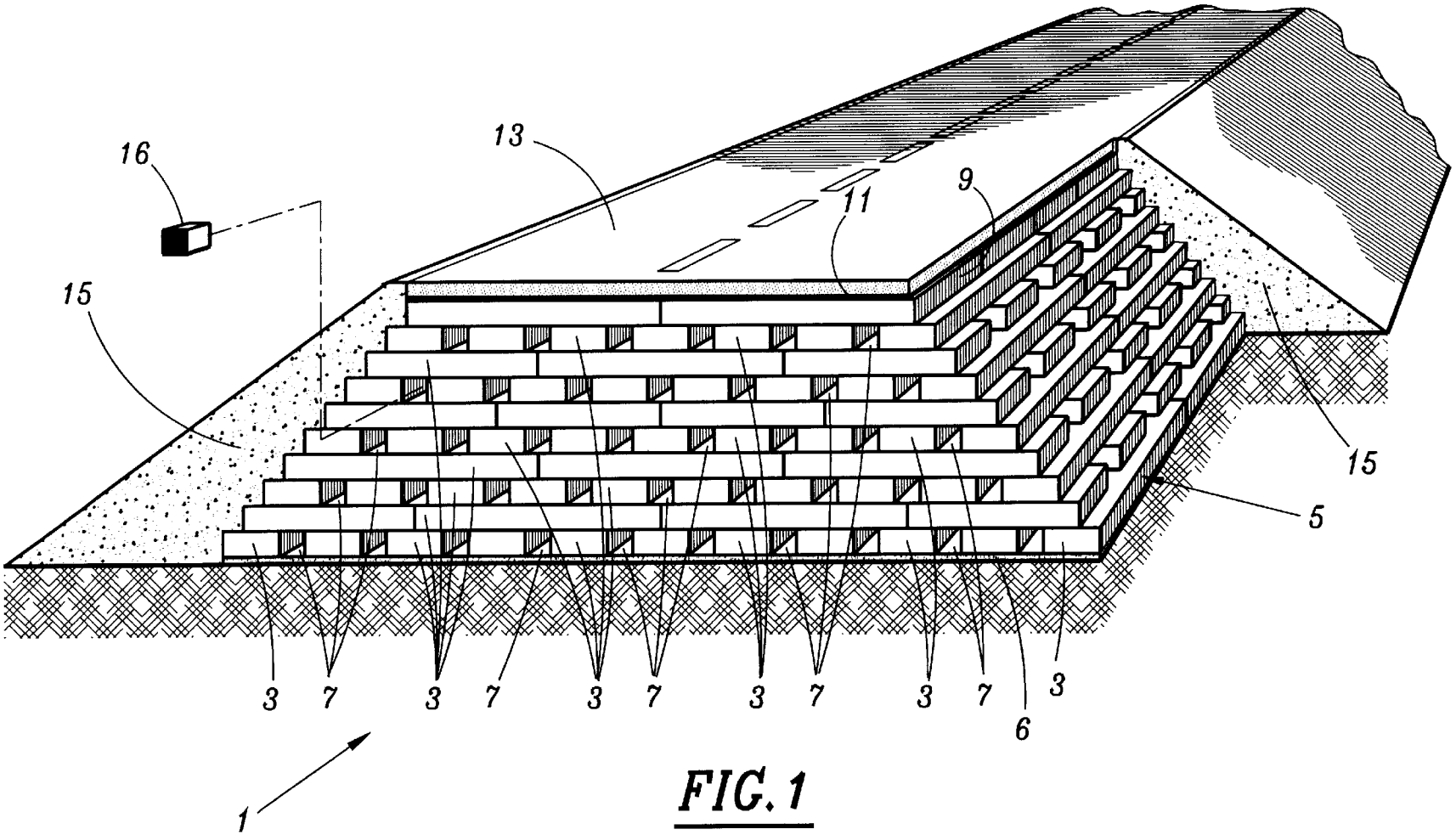
FIG. 1 is a perspective view of a lightweight embankment in accordance with the invention.

The embankment 1 shown in FIG. 1 is designed to support a roadway. Its width decreases progressively from its base towards its apex.

The embankment 1 is constructed from construction blocks 3 of elongate parallelepiped shape stacked up in successive layers, the blocks 3 of the same layer being disposed in parallel rows.

The first layer of the embankment, the base layer 5, rests on a sub-base 6 of unwashed sand or crushed materials approximately 0.1 m thick on average. The blocks 3 of the upper layers are laid transversely to the blocks 3 of the next layer down.

The blocks 3 of each layer are separated from each other by gaps 7. The width of the gaps 7 is constant and less than 1 m and preferably between 0.2 m and 0.6 m.

In one variant, the width of the gaps in the lower layers can be greater than that of the gaps in the upper layers.

This stacking scheme is followed up to the penultimate layer of the lightweight embankment 1. The covering layer 9 is formed of blocks 3 placed contiguously to carry a reinforced concrete slab 11 supporting the blacktop layer 13 of the roadway.

The height of the blocks 3 is between 0.17 m and 1.1 m. The blocks of the same layer are all the same height. In the example shown, this height is uniform for all of the embankment, but in one variant it can vary from one layer to another.

The blocks 3 are made from a light plastics material, in particular expanded polystyrene. By "light plastics material" is meant a plastics material having a density less than 1,000 kg/m$^3$. To withstand the compression stresses to which the blocks are subjected, the density of the material used is greater than 21 kg/m$^3$, in particular greater than 23 kg/m$^3$, and the compressive strength at 10% crushing is greater than 110 kPa, in particular greater than 130 kPa. Despite a higher density of the construction blocks compared to that of the blocks used for the construction of prior art embankments, the total weight of the structure remains almost the same because of the gaps between the blocks of a layer.

To prevent the soil 15 that is deposited laterally on the embankment 1 to stabilize it and conceal it entering the gaps 7, at least one end, preferably all ends, of the gaps 7 are closed by plugs 16 made of the same material as the blocks 3 or by a geotextile membrane.

Figure 2:
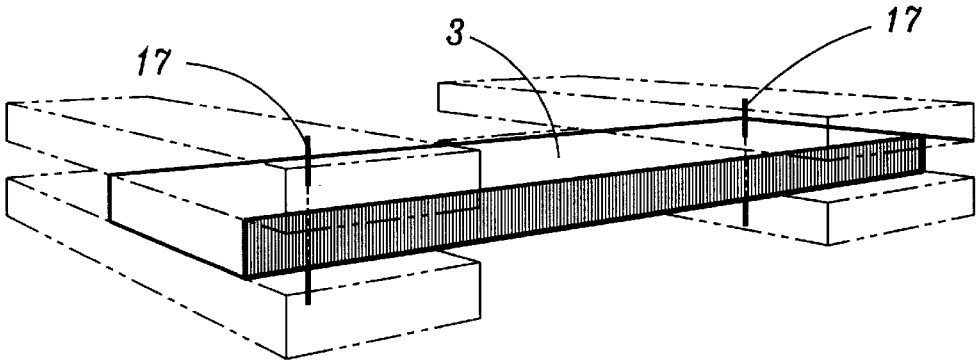
FIG. 2 is a perspective view of a construction block of the lightweight embankment shown in FIG. 1.

To enhance the stability of the embankment and to stay the blocks against lateral displacement, at least some of the construction blocks 3 are provided, during stacking, with connecting means such as those shown in FIG. 2, for example. These connecting means are formed by at least one rod 17 and preferably by two rods 17. These are vertical steel rods having a length greater than the height of an associated construction block 3, which pierce the block near its extremities and project from the block on each side. The projecting parts of the rod 17 are designed to become embedded in blocks of two adjacent layers and thereby stay the blocks against lateral displacement. Rods having a diameter of 8 mm and a length of 1.10 m are generally employed.

Alternatively, and depending on climatic conditions, it is also feasible to glue the blocks together when stacking them by means of an adhesive material, in particular glue.

Figure 3:
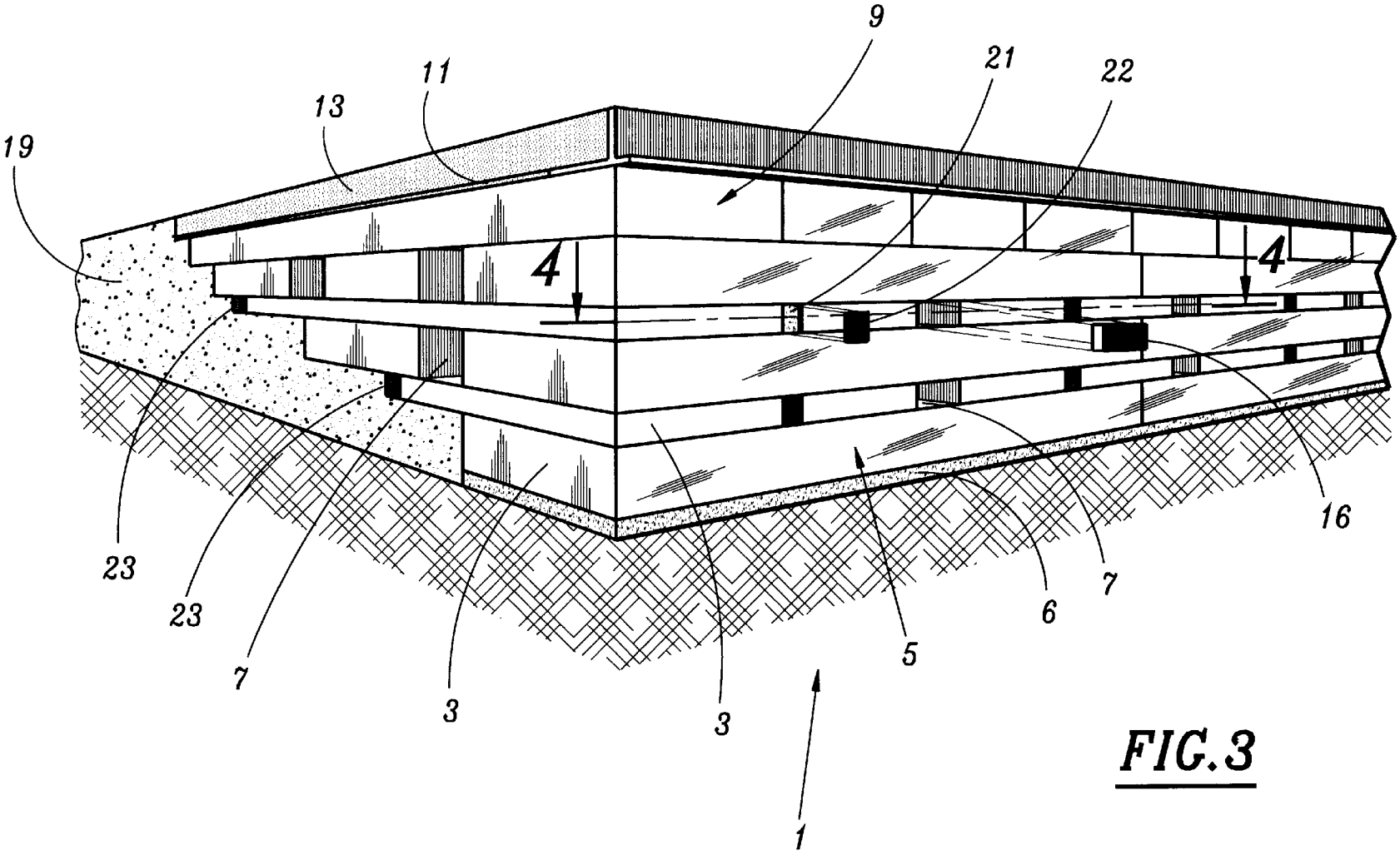
FIG. 3 is a perspective view of a variant of the lightweight embankment designed to be constructed against a slope.

FIG. 3 shows a lightweight embankment 1 designed to be constructed against a slope 19. The sub-base 6 is of crushed materials with a thickness of 0.15 m on average. In this figure, components corresponding to those of FIG. 1 are identified by corresponding numbers.

This variant differs essentially from the embankment shown in FIG. 1 in that locating members 21 are housed in some gaps 7 of the embankment 1.

A locating member 21 of this kind is advantageously obtained by pouring concrete into a gap 7 forming stay-in-place shuttering. To prevent the poured concrete spreading throughout the embankment, the ends of the gap and the openings of the latter that communicate with the gaps of underlying layers are closed by plates or, in the case of the end gaps, by cut blocks 22 of expanded polystyrene that are flush with the free surface of the embankment. Another solution could be to use geotextile membranes for these barriers. The locating members 21 are preferably poured in a gap having a width less than 0.3 m of a layer formed of blocks having a height less than 0.3 m, to prevent an excessive increase in the weight of the embankment.

Figure 4:
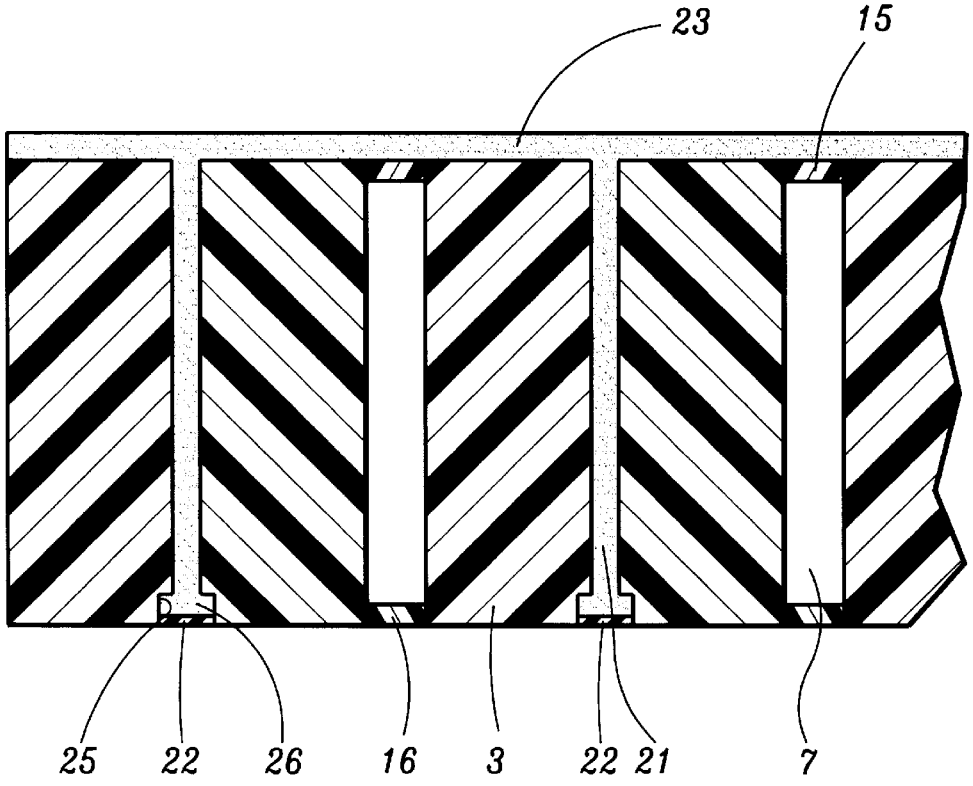
FIG. 4 is a view of the lightweight embankment shown in FIG. 3 in horizontal section taken along the line 4—4.

As can be seen in FIG. 4, the locating members 21 are connected by their end near the slope 19 to a slope anchor member 23. The anchor member 23 is advantageously formed of concrete poured in a gap between the slope 19 and the embankment 1 at the same time as the concrete forming the locating members 21.

The end 25 of the gap 7 forming the stay-in-place shuttering opposite the slope 19 is advantageously widened. The concrete poured into this widened end thereby forms a T-shape retaining member 26.

A lightweight embankment 1 with gaps 7 achieves a considerable saving in the volume of construction material used and accordingly a saving in the order of 20% in transportation costs.

Another advantage of the lightweight embankment of the invention relates to its drainage, especially when it is constructed on land liable to flooding. If the water level rises, water penetrates through the sub-base 6 into the gaps 7 of the base layer 5, which communicate with gaps 7 of higher layers. As the water rises, the gaps 7 of the various layers are progressively filled with water. Consequently, the Archimedean thrust exerted on the embankment as a whole is reduced, with the result that the stability of the embankment 1 is only slightly affected by the flooding.

In one variant the nature and/or density of the blocks is varied from one layer to another for technical-economic optimization in each particular application.

Moreover, at least some of the layers can consist of super-lightweight cellular structure material blocks.

What is claimed is:

1. An embankment, having a density less than 2000 kg/m$^3$, comprising blocks stacked in successive layers, wherein:

each of said blocks has a substantially parallelepipedal elongated general shape and a respective longitudinal axis and two respective longitudinal side faces;

said layers comprise a first layer having first said blocks, the longitudinal axis of each of said first blocks being oriented along a first general direction;

at least two of said first blocks are separated along respective opposed longitudinal side faces by a gap;

said layers comprise a second layer laid on said first layer and having second said blocks;

the longitudinal axis of each of said second blocks is oriented along a second general direction substantially perpendicular to said first general direction; and at least one of said second blocks is laid across said gap.

2. The lightweight embankment according to claim 1 characterized in that the blocks (3) of the same layer are laid in parallel rows.

3. The lightweight embankment according to claim 1 characterized in that the blocks (3) of the same layer have the same height and in that the blocks (3) of at least two different layers have different heights.

4. The lightweight embankment according to claim 1 characterized in that the blocks (3) are made from a plastics material.

5. The lightweight embankment according to claim 4, wherein said plastics material is expanded polystyrene.

6. The lightweight embankment according to claim 1 characterized in that the blocks (3) are made from a material having a density greater than 21 kg/m$^3$, and having a compressive strength at 10% crushing greater than 110 kPa.

7. The lightweight embankment according to claim 6, wherein said density is greater than 23 kg/m$^3$.

8. The lightweight embankment according to claim 7, wherein said compressive strength is greater than 130 kPa.

9. The lightweight embankment according to claim 1 characterized in that at least one block (3) of at least one layer is connected to at least one other block (3) of at least one adjacent layer by connecting means (17).

10. The lightweight embankment according to claim 9 characterized in that the connecting means are formed by an adhesive material.

11. The lightweight embankment according to claim 9 characterized in that the connecting means are formed by at least one rod (17), projecting from the at least one block (3) and adapted to engage in a block (3) of adjacent layers.

12. The lightweight embankment according to claim 11, wherein said at least one rod is a vertical steel rod.

13. The lightweight embankment according to claim 1 characterized in that the width of the gaps (7) of the lower layers is greater than the width of the gaps (7) of the upper layers.

14. The lightweight embankment according to claim 1 comprising a cover layer (9), characterized in that the blocks (3) of the cover layer (9) of the embankment are laid contiguously.

15. The lightweight embankment according to claim 1 characterized in that at least one end of at least one gap (7) is closed by plugs (16).

16. The lightweight embankment according to claim 15, wherein all the ends of all the gaps (7) are closed by the plugs (16).

17. The lightweight embankment according to claim 1 characterized in that at least one of the nature and the density of the blocks varies from one layer to another.

18. An embankment, having a density less than 2000 $kg/m^3$, comprising blocks (3) stacked in successive layers, wherein:

in at least one layer at least two blocks (3) of said at least one layer are separated from each other by a gap (7);

the blocks (3) have a substantially parallelopipedal general shape;

the blocks (3) of two adjacent layers are laid transversely to each other; and at least one elongate horizontally extending embankment locating member (21) is accommodated in at least one gap (7).

19. The lightweight embankment according to claim 18 characterized in that the width of the gaps (7) that house a locating member (21) is less than the width of the other gaps (7) of the same layer and in that the height of the blocks (3) of this layer is less than the height of at least one other layer of the embankment (1).

20. The lightweight embankment according to claim 18 constructed against a slope (19) characterized in that the embankment locating member (21) is connected at one end to a slope anchor member (23).

21. The lightweight embankment according to claim 20, wherein the anchor member is common to a plurality of locating members of the same layer.

22. The lightweight embankment according to claim 1, wherein the anchor member is common to a plurality of locating members of the same layer.

23. The lightweight embankment according to claim 18 characterized in that the embankment locating member (21) is formed by concrete poured into a gap (7) forming stay-in-place shuttering, the ends of this gap (7) and the openings of the latter that communicate with a gap (7) of a lower layer being blocked by barrier members (22).

24. The lightweight embankment, constructed against a slope (19), according to claim 23, characterized in that the embankment locating members (21) are connected at one end to a slope anchor member (23), and in that the slope anchor member (23) is formed by concrete poured into a gap between the slope (19) and the embankment (1).

25. The lightweight embankment according to claim 23 constructed against a slope characterized in that at least one end of at least one gap (7) forming stay-in-place shuttering has a widened part (25) in which the locating member (21) forms a retaining member (26) for the blocks (3) of the embankment.

26. An embankment, having a density less than 2000 $kg/m^3$ and constructed against a slope (19), and comprising blocks (3) stacked in successive layers, wherein:

in at least one layer at least two blocks (3) of said at least one layer are separated from each other by a gap (7);

at least one elongate horizontally extending embankment locating member (21) is accommodated in at least one gap (7);

each embankment locating member (21) is connected at one end to a slope anchor member (23); and the at least one embankment locating member is formed by concrete poured into a gap (7) forming stay-in-place shuttering, the ends of the gap (7) and the openings thereof, that communicate with another gap (7) of a lower layer, being blocked by barrier members (22).

* * * * *